United States Patent [19]

Mitsui et al.

[11] Patent Number: 4,549,158

[45] Date of Patent: Oct. 22, 1985

[54] INDUCTANCE ELEMENT

[75] Inventors: Tadashi Mitsui, Tokyo; Masaru Wasaki, Chiba, both of Japan

[73] Assignee: TDK Corporation, Tokyo, Japan

[21] Appl. No.: 675,468

[22] Filed: Nov. 28, 1984

Related U.S. Application Data

[63] Continuation of Ser. No. 306,886, Sep. 30, 1981, abandoned, which is a continuation of Ser. No. 91,783, Nov. 6, 1979, abandoned.

[30] Foreign Application Priority Data

Nov. 9, 1978 [JP] Japan ..... 53-153501[U]
Nov. 9, 1978 [JP] Japan ..... 53-153502[U]

[51] Int. Cl.[4] ..... H01F 15/02; H01F 27/30

[52] U.S. Cl. ..... 336/83; 336/65; 336/192; 336/198; 336/210

[58] Field of Search ..... 336/83, 192, 198, 208, 336/210, 178, 221, 65

[56] References Cited

U.S. PATENT DOCUMENTS

| | | | |
|---|---|---|---|
| 3,007,125 | 10/1961 | Furbee | 336/221 |
| 3,076,165 | 1/1963 | Weyrich | 336/192 X |
| 3,332,049 | 7/1967 | Hisano | 336/198 X |
| 3,354,417 | 11/1967 | Davis | 336/192 X |
| 3,371,301 | 2/1968 | Hisano | 336/83 |
| 3,665,358 | 5/1972 | Leucke et al. | 336/198 X |
| 3,668,586 | 6/1972 | Horbach | 336/210 |
| 4,075,590 | 2/1978 | Foldes | 336/210 X |
| 4,095,206 | 6/1978 | Hishiki | 336/210 X |
| 4,150,278 | 4/1979 | Resener | 336/83 X |
| 4,352,080 | 9/1982 | Mitsui et al. | 336/83 |
| 4,424,504 | 1/1984 | Mitsui et al. | 336/83 |

FOREIGN PATENT DOCUMENTS

| | | | |
|---|---|---|---|
| 1439276 | 10/1968 | Fed. Rep. of Germany | 336/83 |
| 2301519 | 10/1973 | Fed. Rep. of Germany | 336/198 |
| 2724022 | 12/1978 | Fed. Rep. of Germany | 336/83 |
| 1400837 | 4/1965 | France | 336/83 |
| 0012721 | 1/1980 | Japan | 336/83 |
| 1407501 | 9/1975 | United Kingdom | 336/83 |

*Primary Examiner*—Thomas J. Kozma
*Attorney, Agent, or Firm*—Robert Scobey

[57] ABSTRACT

An inductance element of the type that includes a coil bobbin having flanges at the ends thereof, a pair of pot cores engaging the bobbin, and a fastening member for fastening together the pot cores and bobbin. At least one of the bobbin flanges includes a joining part that extends outwardly from the bobbin flange and engages both the adjacent one of the pot cores and the fastening member to prevent relative rotation of the bobbin and adjacent pot core and fastening member. One of the bobbin flanges may include a stepped part having pins extending therefrom for making electrical connection to the inductance element. The stepped part is spaced from the bobbin flange, and connection wires may extend within the space.

6 Claims, 6 Drawing Figures

INDUCTANCE ELEMENT

This is a continuation of application Ser. No. 306,886, filed Sept. 30, 1981, now abandoned, which is a continuation of application Ser. No. 06/091,783, filed Nov. 6, 1979, now abandoned.

BACKGROUND AND BRIEF DESCRIPTION OF THE INVENTION

This invention generally relates to an inductance element, and more particularly to an inductance element of the type that includes a coil bobbin engaged by a pair of pot cores and fastened together by a fastening member to form a complete inductance element.

It is known to provide a projection on a portion of one of the flanges of a coil bobbin which engages with the associated pot core for preventing undesirable turning or rotation of the coil bobbin within the pot core. In known structures, the fastening member includes a bent portion for holding the side face of the pot core, since the fastening member and the coil bobbin are independent of each other. As a result, such a conventional fastening member is costly and requires more steps in a manufacturing and assembling process.

It is also known to include terminal pins on one of the flanges of a bobbin for making connection to the inductance element. Often times, connecting conductors from the coil in the element to the pins are crowded within the structure, and short circuits may occur.

Accordingly, it is an object of the present invention to overcome the problems noted above.

A specific object of the invention is to provide an improved inductance element which may be simply assembled for the easy positioning of the three component parts thereof, namely, the coil bobbin, the core structure and the fastening member.

These objects are achieved by utilizing a joining part on at least one of the bobbin flanges that extends outwardly from the flange and engages both the adjacent one of the pot cores and the fastening member to prevent relative rotation of the bobbin and adjacent pot core and fastening member. Additionally, one of the bobbin flanges may include a stepped part thereof, which has pins extending therefrom for making electrical connection to the inductance element. The stepped part extends parallel to the bobbin flange of which it is a part, and is joined to this latter bobbin flange by a projection perpendicular thereto. This projection preferably engages the adjacent one of the pot cores to prevent relative rotation between that pot core and the bobbin. Connection wires may be positioned within the space between the bobbin flange and the stepped part, avoiding short circuit problems. A spacer may be included on the bobbin flanges that includes the stepped part also to accommodate electrical connections and to avoid short circuit problems.

The invention will be more completely understood by reference to the following detailed description.

DETAILED DESCRIPTION

Figure 1:
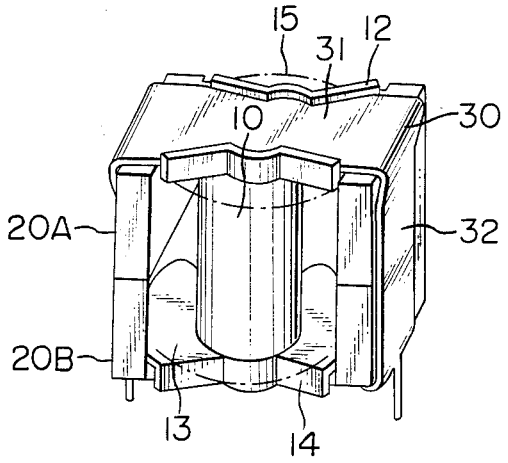
FIG. 1 is a perspective view of an inductance element embodying the invention.
Figure 2:
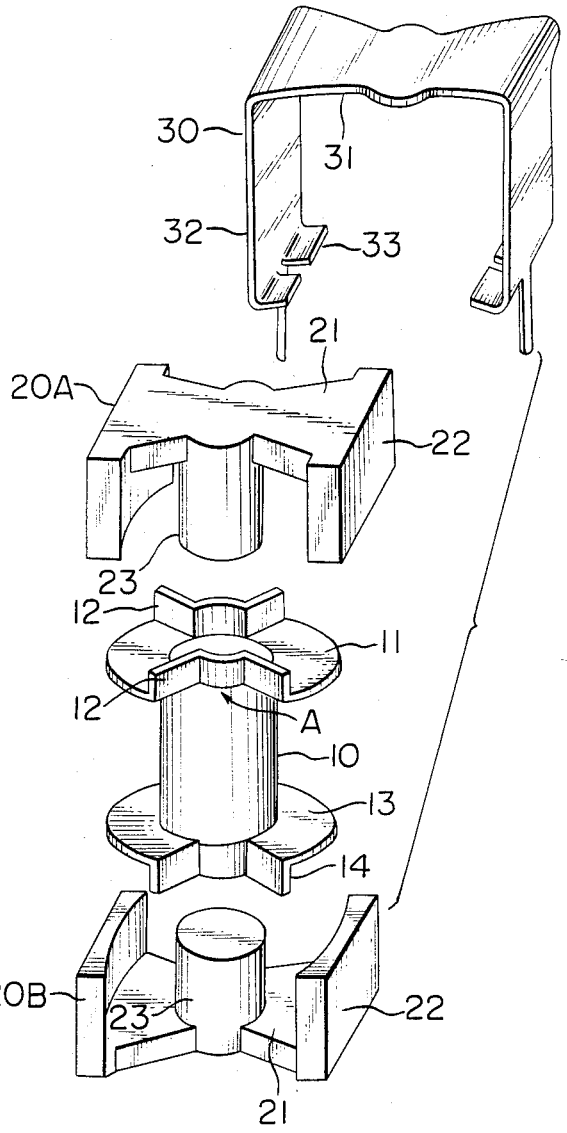
FIG. 2 is an exploded perspective view of the inductance element of FIG. 1.

Referring to FIGS. 1 and 2, sectoral recesses A are formed oppositely on an upper flange 11 of a coil bobbin 10. A joining part 12 is formed along each said sectoral recess A, normal to the flange 11, extending outwardly from the bobbin flange 11. Each joining part 12 is constituted of a plurality of individual curve segments as is evident from FIG. 2, i.e., a central arcuate section flanked by two straight-line sections. Joining parts 14 are similarly preferably formed on the lower flange 13 of the coil bobbin 10. A coil 15 is fitted on the bobbin, and a pair of pot cores 20A and 20B are included. The pot cores are each formed of a disc portion 21, external shells 22, and a cylindrical slug 23. The joining parts 12 and 14 of the coil bobbin 10 engage snuggly with the disc portions 21, thereby preventing relative rotation between the coil bobbin and the pot cores. A fastening member 30 is included for fastening together the pot cores and the bobbin, including the coil, and is formed of a U-shaped elastic or flexible curved plate having an upper face 31, side walls 32, and fastening portions 33 formed by bending inwardly the end portion of each side wall 32. The upper face 31 is shaped so that at least a part thereof fits inside the joining part 12 of the coil bobbin 10, thereby preventing relative rotation between the fastening member and the coil bobbin.

In assembling the component parts, the pot cores 20A and 20B are respectively fitted onto the upper and lower parts of the coil bobbin 10 (which coil bobbin is mounted with a coil 15), so that the discs 21 of the pot cores engage with the respective joining parts 12 and 14 of the coil bobbin. Thereafter, the fastening member 30 is fitted in place to retain the pot cores in position, with the upper face 31 of the fastening member engaging the joining part 12 of the coil bobbin 10. In this fashion, the joining part 12 simultaneously contacts and engages both the adjacent pot core 20A and the fastening member 30 to prevent relative rotation of the bobbin and that adjacent pot core and the fastening member. At the same time, the joining part 14 depending from the lower bobbin flange 13 engages the pot core 20B, preventing relative rotation between that pot core and the bobbin.

This embodiment has the following advantages:

1. Positioning of the pot cores 20A and 20B and the fastening member 30 is fascilitated. Productivity is improved since the coil bobbin 10 is provided with a joining part 12 which easily determines the relative position of the pot core 20A and the fastening member 30.

2. The simplified shape of the fastening member 30 reduces manufacturing time, steps and costs.

3. Protection of the insulation on the lead wires of the coil 15 is improved, since the joining parts 12 and 14 formed on the coil bobbin 10 cover the side faces of the pot cores 20A and 20B and the fastening member 30.

4. The joining part 14 formed on the lower bobbin flange 13 enables a space to be formed between the bottom surface of the pot core 20B and a printed circuit plate or board (not shown) when the inductance element is mounted upon such a printed circuit board. In this fashion short circuiting between the circuit on the board and the inductance element is prevented.

Figure 3:
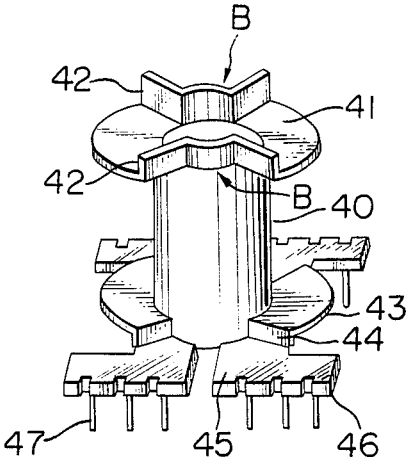
FIG. 3 is a perspective view of an alternative form of bobbin embodying the invention.
Figure 4:
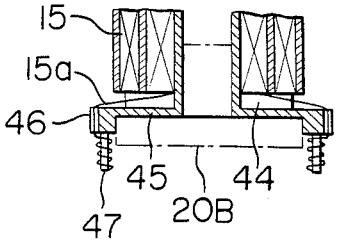
FIG. 4 is a sectional view of the lower half of a transformer incorporating the bobbin of FIG. 3.

FIG. 3 shows a modified form of bobbin embodying the invention. The upper part of bobbin 40 is similar to the upper part of bobbin 10 in FIG. 2, and includes sectoral recesses B formed oppositely on upper bobbin flange 41. Joining parts 42 are formed along each sectoral recess B, and extend normal to the flange 41 outwardly from the bobbin. A step 44 is formed on lower flange 43 to provide stepped part 45 forming a part of the lower bobbin flange 43. Separations 46 are formed on the stepped part 45, and a terminal pin 47 is fixed to each separation 46. Pot cores the same as pot cores 20A and 20B shown in FIG. 2 are fitted respectively on the upper and lower parts of the coil bobbin 40. The discs 21 of these pot cores engage the joining parts 42 and 44 of the bobbin 40, and a fastening member 30, also as shown in FIG. 2, is fitted in place to secure the pot cores and bobbin 40 together as an assembly. The use of the coil bobbin 40 shown in FIG. 3 fascilitates the connection of the coil lead wires to the terminal pins 47 and the insulation thereof by virtue of the step 44, as shown in FIG. 4. The step 44 provides a space within which wires 15*a* of the coil 15 may be positioned. Short circuiting is thereby avoided, since the lead-in wires are not pressed tightly against the coil 15, as is the case with prior art structure.

The stepped portion of the bobbin may be included at the top thereof, if desired, although in the preferred form shown in FIGS. 3 and 4 it is located at the lower portion of the bobbin.

The embodiments of FIGS. 1–4 provide an inductance element of improved assembly procedure, which simplifies the fixing of the relative positions of the three component members of the element, namely, the coil bobbin, the cores, and the fastening member.

Figure 5:
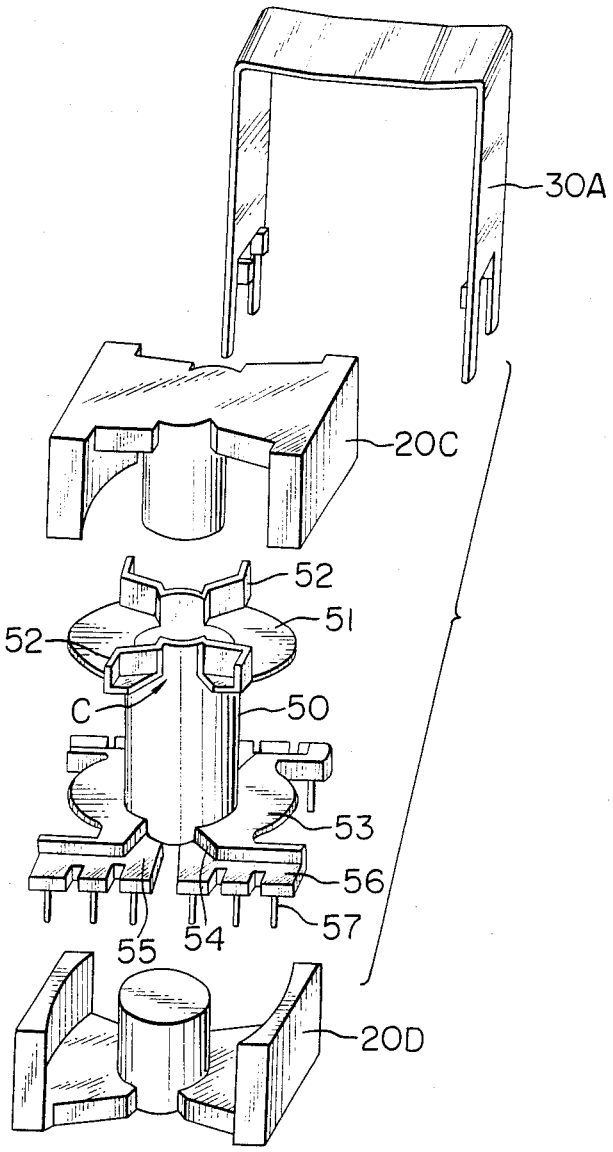
FIG. 5 is an exploded perspective view of another inductance element embodying the invention.
Figure 6:
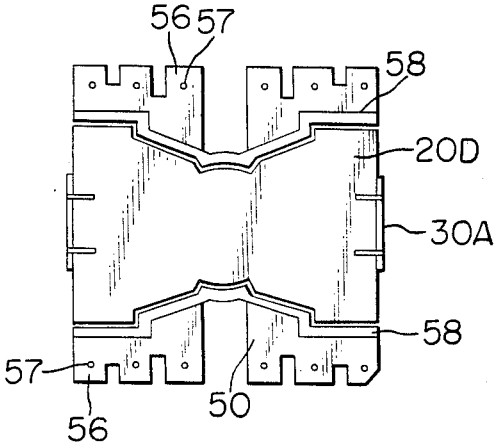
FIG. 6 is a bottom plan view of an inductance element of the type shown in FIG. 5.

FIGS. 5 and 6 illustrate a similar, but slightly different form of inductance element. Changes are made in the shapes of various parts of the elements. An upper flange 51 of a bobbin 50 is provided with narrow sectoral recesses C and includes joining parts 52 extending away from the upper flange. The shape of the joining parts 52 is slightly different from that of the joining parts 12 shown in FIG. 2. The lower portion of the bobbin includes step 54 formed on lower flange 53 at positions corresponding to the sectoral recesses on the upper flange 51. Thus stepped parts 55 are formed which are lower than the level of the inside surface of the lower flange 53. Separations 56 are formed in the stepped parts 55, and terminal pins 57 are fixed to the separations. A spacer 58 projects from the outside face of the lower flange 53 along the pot core 20D. Spacer 58 prevents accidental contacting of the junctions of the coil lead wires and the terminal pins with the base plate of the assembly. The pot cores 20C and 20D are fitted respectively from the upper and lower ends of the bobbin, as in the embodiment of FIG. 2, and then the fastending member 30A (slightly different in shape from the fastening member 30 in FIG. 2; as evident from FIG. 5, the edges of the fastening member 30A are not shaped to interfit with the joining parts 52) is attached over the pot cores 20C and 20D, passing between the joining parts 52. In this assembly, the width of the recesses C and the stepped parts 55 are relatively narrow, and it is thus of advantageous form in winding coils of relatively thin wires on the bobbin.

Various specific embodiments of the invention have been disclosed. It is apparent that modifications are possible. Accordingly, the invention should be taken to be defined by the following claims.

We claim:

1. An inductance element comprising: a pair of pot cores, each pot core comprising a cylindrical slug and opposed shells spaced from and partially surrounding said slug, each of said opposed shells being joined to said slug at an end of said slug by a disc portion that partially circumferentially extends about said slug, a coil bobbin comprising a hollow cylindrical member with opposed flanges at each end thereof extending generally perpendicular to the longitudinal axis of said cylindrical member and outwardly from the external surface of said cylindrical member, each of said flanges extending partially circumferentially about said cylindrical member along a first arc thereof and mating with a corresponding one of said disc portions, said flanges at one end of said coil bobbin each including a joining part extending away therefrom which engages with and interfits with a corresponding one of said pot cores, said joining parts each including a stepped part at a level spaced from that of said flange to which it is joined, said stepped parts having portions thereof that extend about said cylindrical member along second arcs thereof different from said first arcs, said stepped part carrying connectors for making electrical connection to the inductance element, and a fastening member extending at least partially about said pot cores for joining together said pot cores and coil bobbin.

2. An inductance element according to claim 1, in which each joining part extends outwardly from the bobbin flange of which it is a part and engages corresponding parts of both the adjacent one of said pot cores and said fastening member to prevent relative rotation of said bobbin and said adjacent one of said pot cores and said fastening member.

3. An inductance element according to claim 1, including one or more coils on said bobbin wound between the bobbin flanges at opposite ends of said bobbin, and coil connection wires extending in the spaces between said opposed bobbin flanges at said one end of said coil bobbin and between these latter bobbin flanges and said stepped parts joined thereto.

4. An inductance element according to claim 1, in which said stepped part extends parallel to the bobbin flange of which it is a part and is joined to the latter bobbin flange by a projection perpendicular thereto, said projection constituting said joining part and engaging the adjacent one of said pot cores to prevent relative rotation between that pot core and said bobbin.

5. An inductance element according to claim 4, including a coil on said bobbin wound between the bobbin flanges at opposite ends of said bobbin, said coil having connection wires extending in the spaces between said bobbin flanges and said associated stepped parts.

6. An inductance element according to claim 1, in which said stepped part extends outwardly from said cylindrical member for a greater radial distance than said flange to which it is joined.

* * * * *